US010851488B2

(12) United States Patent
Kim et al.

(10) Patent No.: US 10,851,488 B2
(45) Date of Patent: Dec. 1, 2020

(54) DOOR LOCKING DEVICE AND WASHING MACHINE HAVING THE SAME

(71) Applicant: Samsung Electronics Co., Ltd., Suwon-si (KR)

(72) Inventors: Ju-Yeong Kim, Suwon-si (KR); Nam Soo Park, Suwon-si (KR); Jea Won Lee, Hwaseong-si (KR); Hyeon Kyu Lim, Suwon-si (KR); Dong-il Back, Hwaseong-si (KR); Jun-young Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/069,490

(22) PCT Filed: Feb. 8, 2017

(86) PCT No.: PCT/KR2017/001383
§ 371 (c)(1),
(2) Date: Jul. 11, 2018

(87) PCT Pub. No.: WO2017/142249
PCT Pub. Date: Aug. 24, 2017

(65) Prior Publication Data

US 2019/0024287 A1 Jan. 24, 2019

(30) Foreign Application Priority Data

Feb. 18, 2016 (KR) ..... 10-2016-0019130

(51) Int. Cl.
*E05B 47/00* (2006.01)
*E05B 47/06* (2006.01)
(Continued)

(52) U.S. Cl.
CPC ..... *D06F 37/10* (2013.01); *D06F 37/28* (2013.01); *D06F 37/42* (2013.01); *D06F 39/14* (2013.01);
(Continued)

(58) Field of Classification Search
CPC ..... Y10S 292/37; Y10S 292/69; Y10T 292/1028; Y10T 292/096; Y10T 292/0969;
(Continued)

(56) References Cited

U.S. PATENT DOCUMENTS 939,174 A * 11/1909 Schlapbach ..... E05B 63/128 292/150
1,339,492 A * 5/1920 Belden ..... E05B 63/12 292/221
(Continued)

FOREIGN PATENT DOCUMENTS

CN 103361931 A 10/2013
CN 103361933 A 10/2013
(Continued)

OTHER PUBLICATIONS

Supplementary European Search Report dated Aug. 20, 2018 in connection with European Patent Application No. 17 75 3410, 9 pages.
(Continued)

*Primary Examiner* — Carlos Lugo

(57) ABSTRACT

In a washing machine having a door locking device that allows a door to keep an opening closed, the door locking device includes a latch configured to move in a first direction to restrict the door and move in a second direction, which is opposite the first direction, to release the restriction on the door and a locker configured to limit movement of the latch in the second direction. By such a configuration, the door
(Continued)

can be opened/closed, restricted, and opened using a single device.

5 Claims, 24 Drawing Sheets

(51) Int. Cl.
*D06F 37/10* (2006.01)
*D06F 37/42* (2006.01)
*D06F 39/14* (2006.01)
*D06F 37/28* (2006.01)

(52) U.S. Cl.
CPC ..... *E05B 47/0001* (2013.01); *E05B 47/0012* (2013.01); *E05B 47/0603* (2013.01); *E05B 2047/0067* (2013.01); *E05Y 2900/312* (2013.01); *Y10S 292/37* (2013.01); *Y10S 292/69* (2013.01); *Y10T 292/0969* (2015.04); *Y10T 292/1028* (2015.04)

(58) Field of Classification Search
CPC ..... Y10T 292/0977; Y10T 292/0993; Y10T 292/0997; Y10T 292/1021; Y10T 292/307; Y10T 292/308; E05B 47/0603
USPC ..... 292/142, 150, 279, 159, 160
See application file for complete search history.

(56) References Cited

U.S. PATENT DOCUMENTS 1,769,288 A * 7/1930 Godfried ..... E05B 63/248 292/254
1,816,134 A * 7/1931 Wood ..... E05B 63/20 292/333
1,965,939 A * 7/1934 Jacobi ..... E05B 83/30 70/81
2,014,363 A * 9/1935 Whitted ..... E05B 63/244 74/503
2,047,401 A * 7/1936 Whitted ..... E05B 63/244 292/220
2,219,186 A * 10/1940 Hornfeck ..... E05C 19/163 292/144
2,228,674 A * 1/1941 Raymond ..... E05B 85/24 70/264
3,040,555 A * 6/1962 Wartian ..... E05C 3/24 70/97
4,179,143 A * 12/1979 Shy ..... E05C 1/04 292/150
4,476,700 A * 10/1984 King ..... E05C 9/041 292/39
5,092,637 A * 3/1992 Miller ..... E05B 17/0037 292/150
5,193,861 A * 3/1993 Juga ..... E05C 3/34 292/207
5,520,026 A * 5/1996 Ackland ..... D06F 37/42 68/12.26
6,603,377 B2 8/2003 Cho et al.
7,347,460 B2 * 3/2008 Ala ..... A47L 15/4259 292/216
7,770,944 B2 * 8/2010 Yuan ..... E05B 47/0012 292/195
8,033,583 B2 * 10/2011 Chang ..... E05B 47/0603 292/144
8,085,530 B2 * 12/2011 Zhang ..... G06F 1/187 211/26
8,360,485 B2 * 1/2013 Ma ..... H05K 5/0221 292/137
2007/0274034 A1 * 11/2007 Yang ..... G06F 1/187 361/679.39
2015/0292135 A1 10/2015 Wishney et al.

FOREIGN PATENT DOCUMENTS

CN 203782428 U 8/2014
CN 104975476 A 10/2015
EP 0148701 A2 * 7/1985 ..... E05B 47/0002
KR 10-2008-0109221 A 12/2008
KR 10-0883413 B1 2/2009
KR 10-0888655 B1 3/2009
KR 10-2010-0081226 A 7/2010
KR 10-2012-0047473 A 5/2012
KR 10-1236951 B1 2/2013
KR 10-2015-0118230 A 10/2015
WO 2013/150410 A1 10/2013
WO 2015/140306 A1 9/2015

OTHER PUBLICATIONS

Examination Report dated Sep. 11, 2018 in connection with Australian Patent Application No. 2017221661, 4 pages.
ISA/KR, "International Search Report and Written Opinion," International Application No. PCT/KR2017/001383, dated Apr. 27, 2017, 12 pages.
IP Australia Notice of acceptance for patent application dated Jan. 23, 2019 regarding Application No. 2017221661, 3 pages.
National Institute of Industrial Property (INAPI Chile) Expert Report dated Feb. 12, 2019 regarding Application No. 201703230, 13 pages.
European Patent Office Communication under Rule 71(3) EPC dated Feb. 19, 2019 regarding Application No. 17753410.4, 66 pages.
Office Action dated Aug. 8, 2019 in connection with Chile Patent Application No. 201703230, 16 pages.
Examination Report and the Written Comments of the Examining Body in connection with Iranian Application No. 139650140003010833, 12 pages.
Examination Report in connection with Indian Application No. 201817001286 dated Feb. 28, 2020, 7 pages.
The First Office Action in connection with Chinese Application No. 20170003190.4 dated Jun. 3, 2020, 23 pages.

* cited by examiner

【Fig. 1】
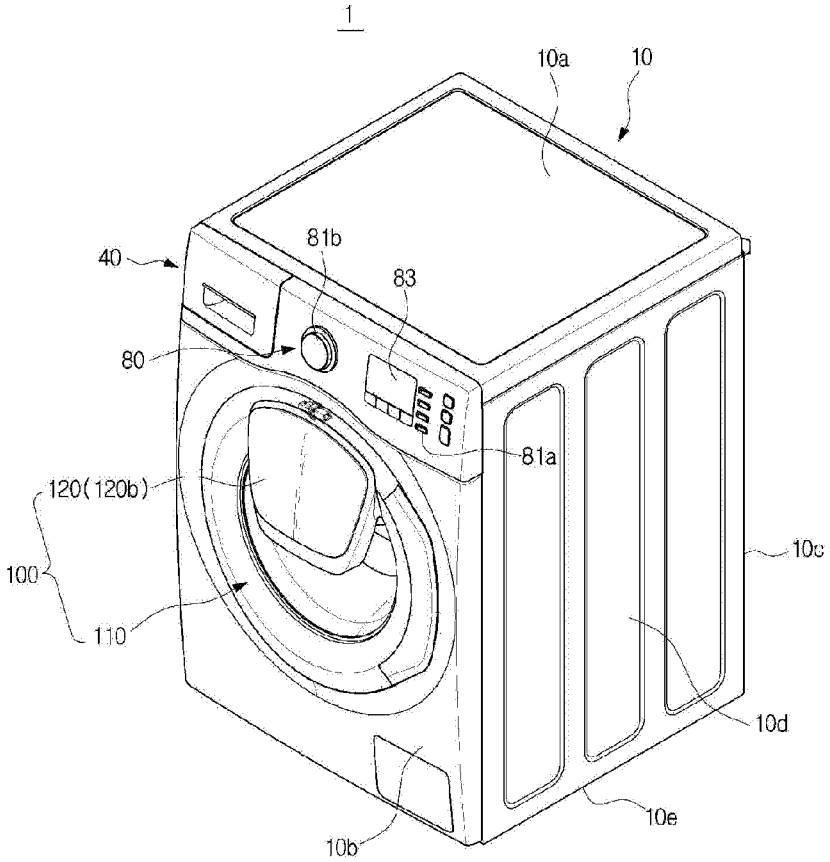

【Fig. 2】
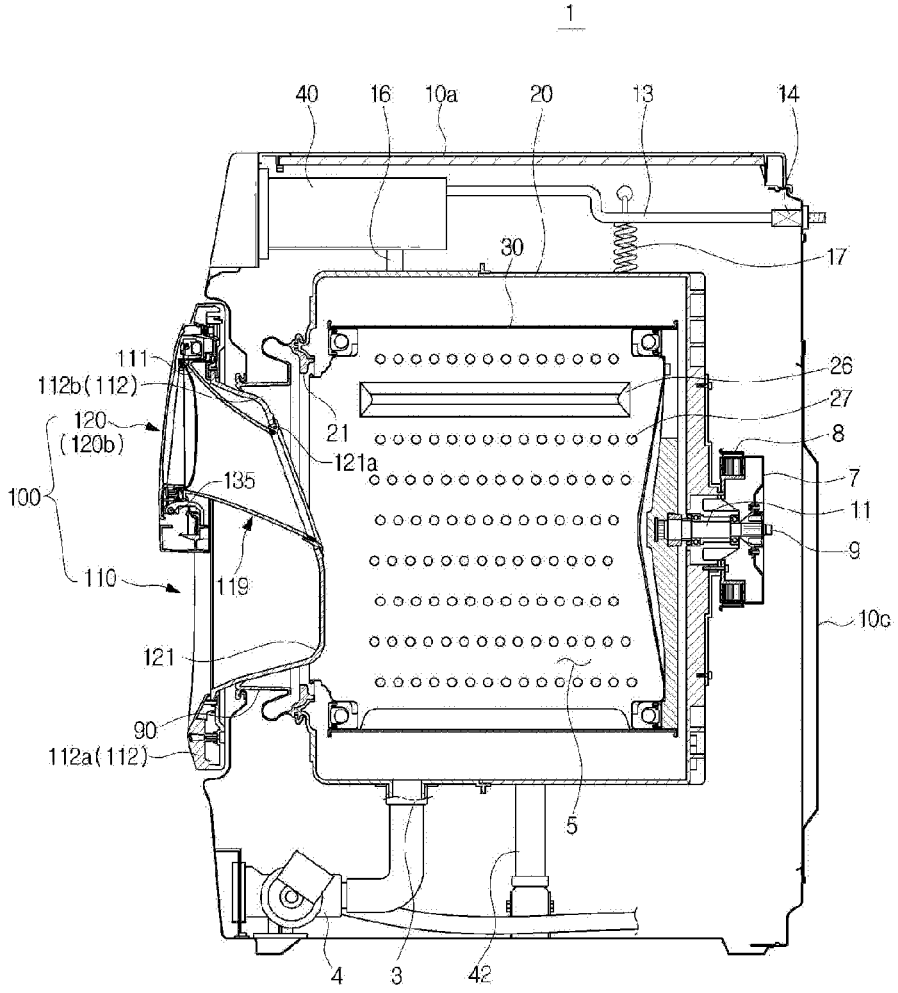

【Fig. 3a】
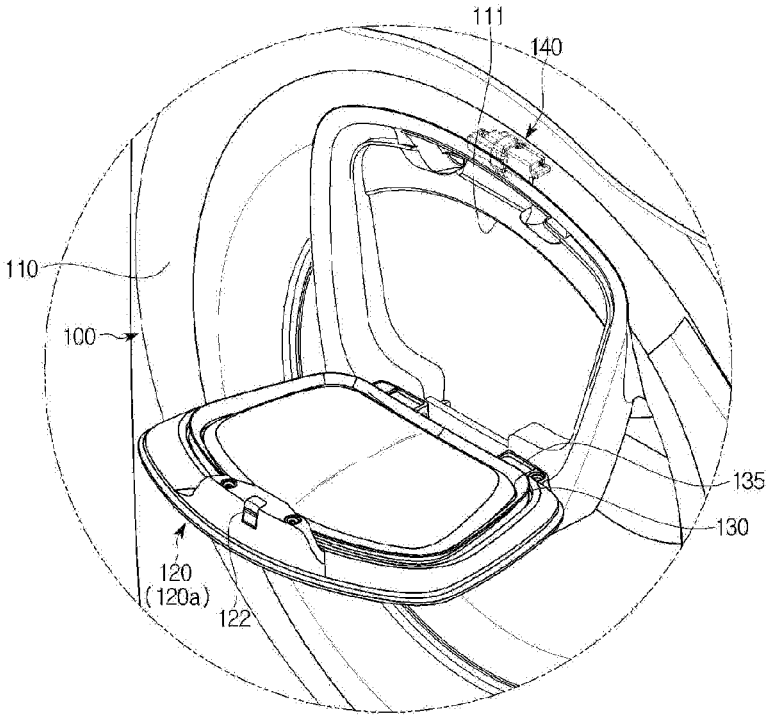

【Fig. 3b】
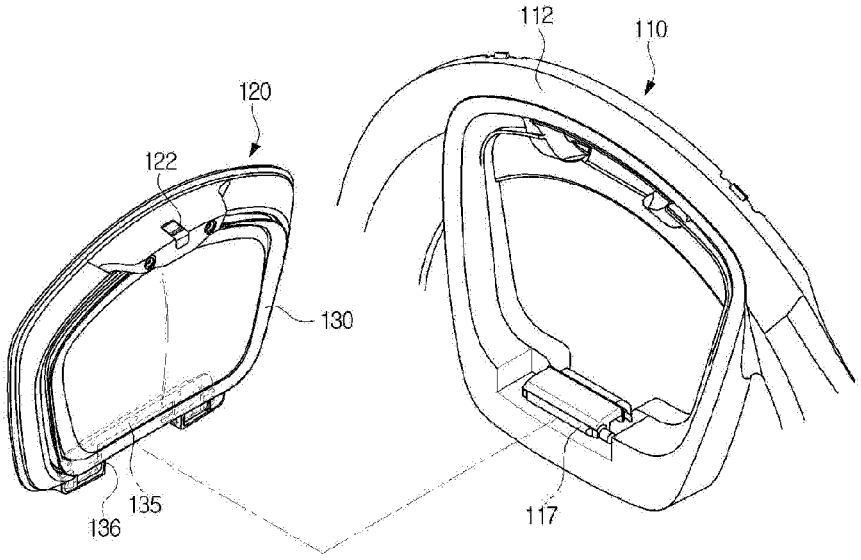

【Fig. 4】
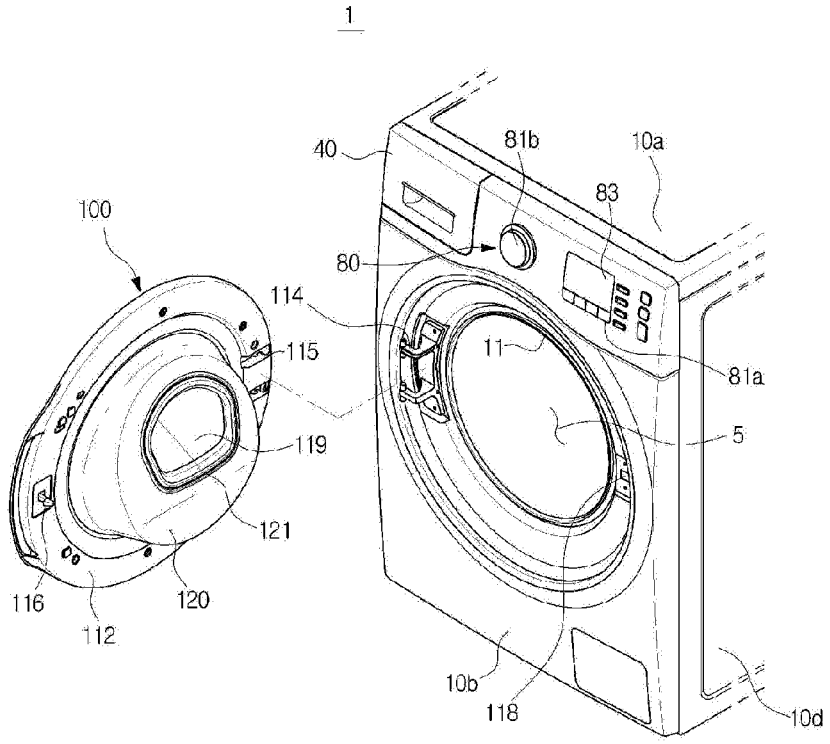

【Fig. 5】
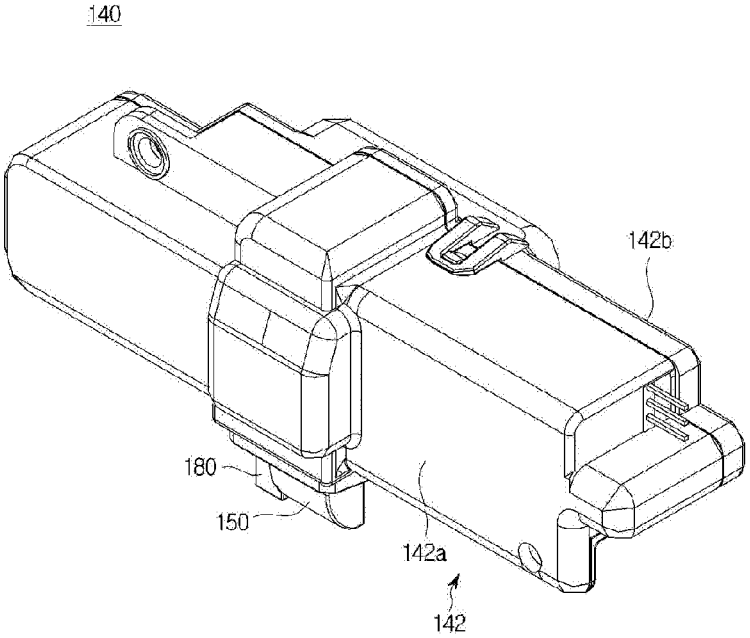

[Fig. 6]
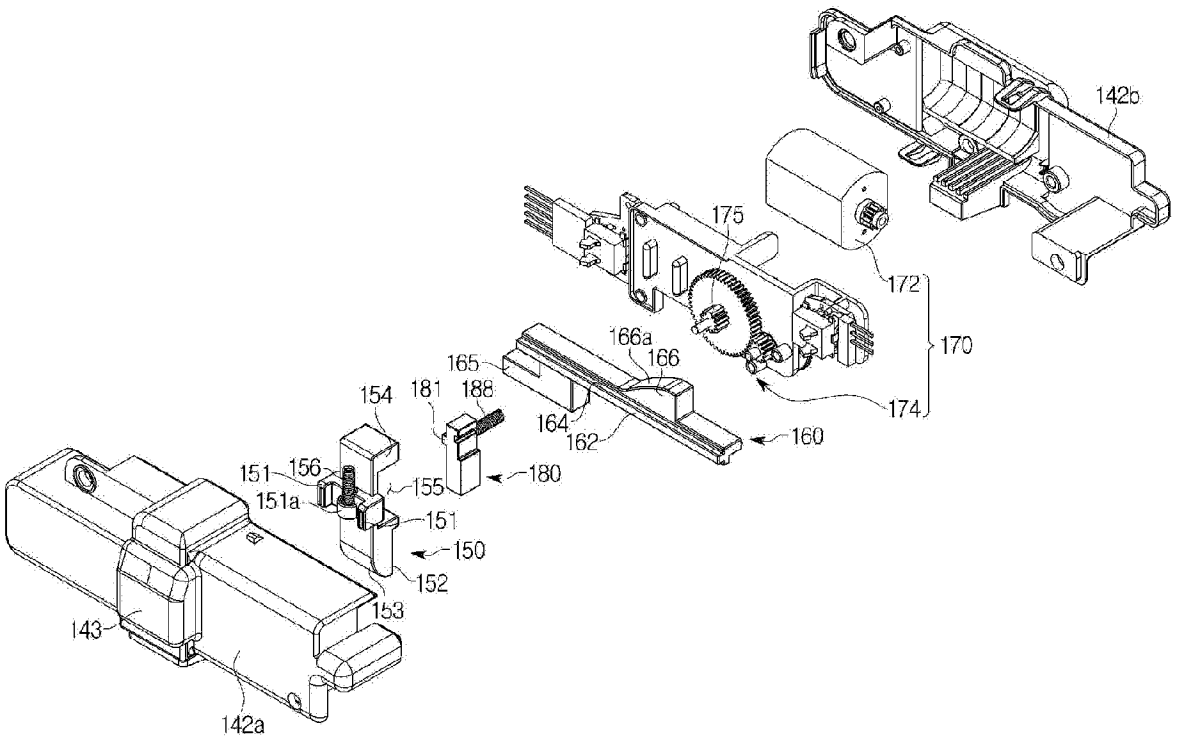

【Fig. 7】
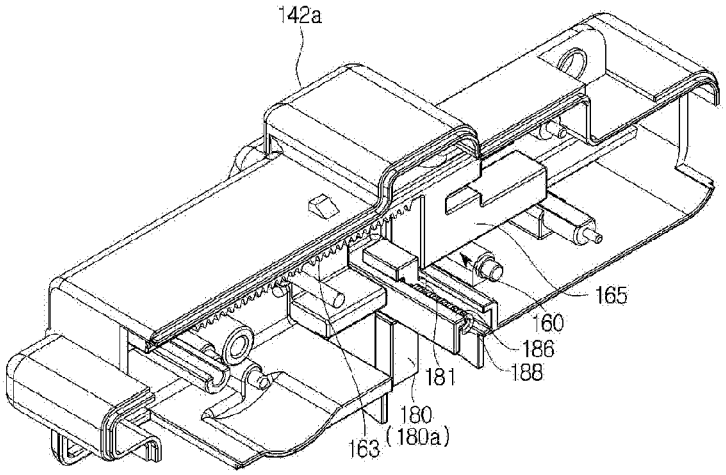

【Fig. 8】
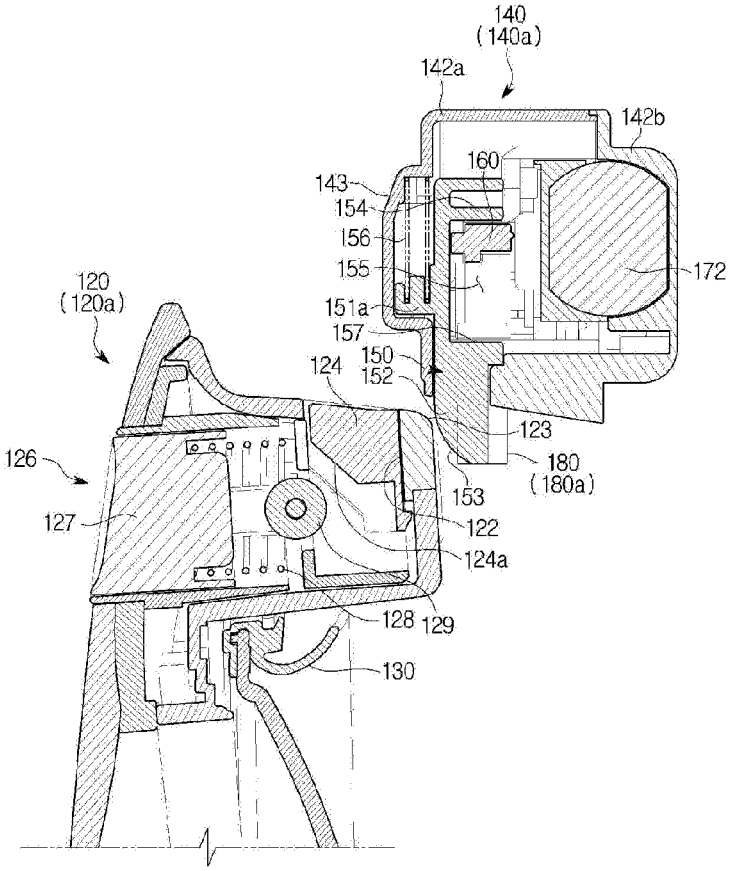

【Fig. 9】
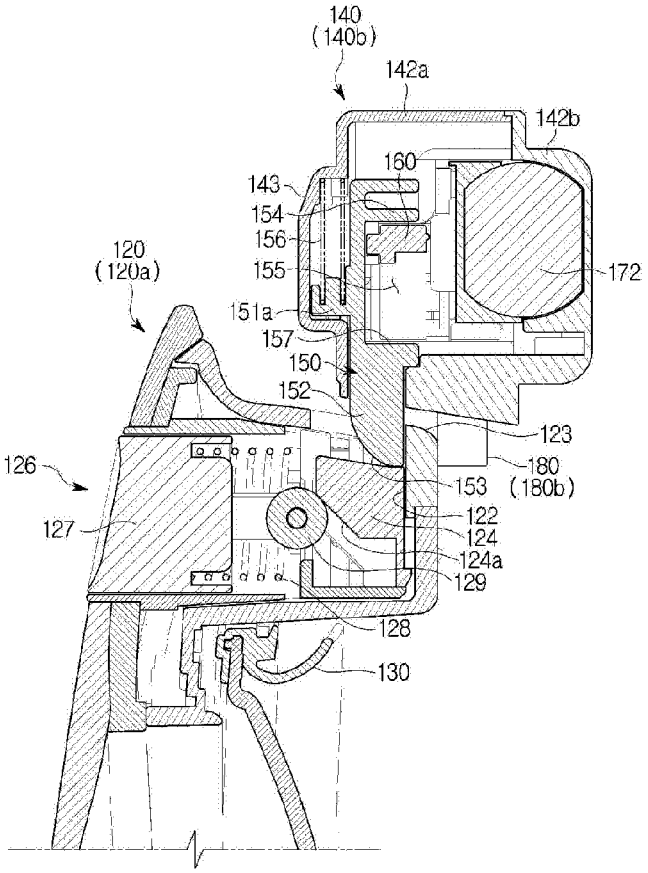

【Fig. 10】
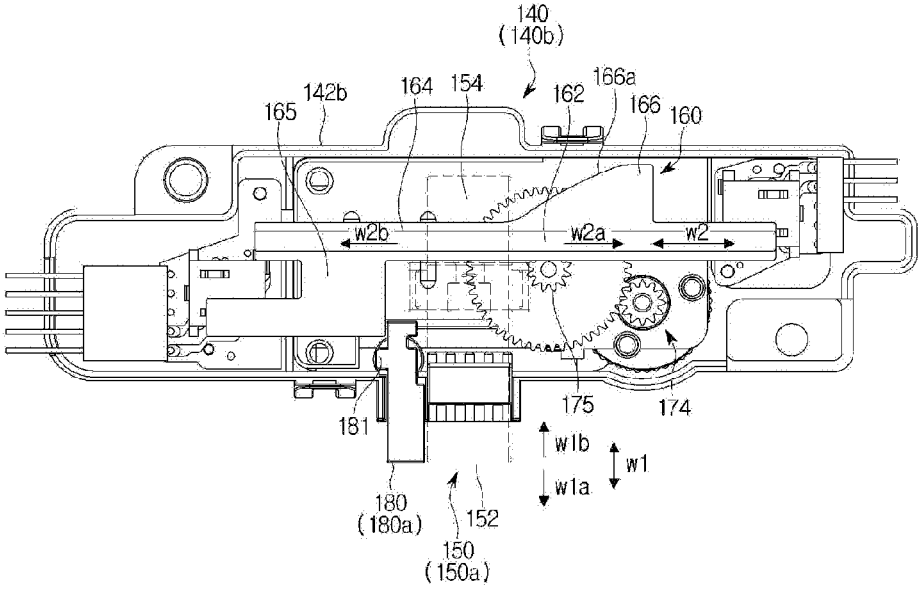

【Fig. 11】
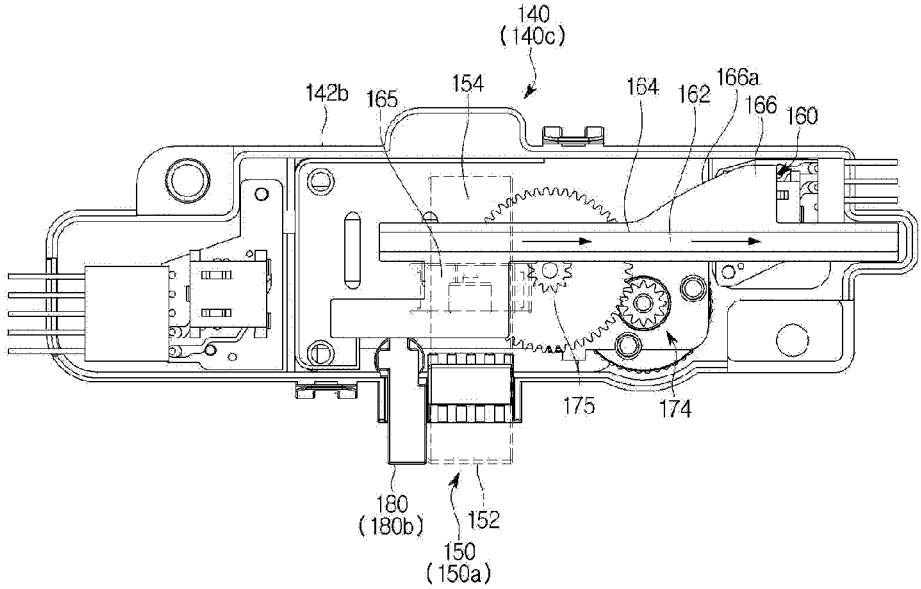

【Fig. 12】
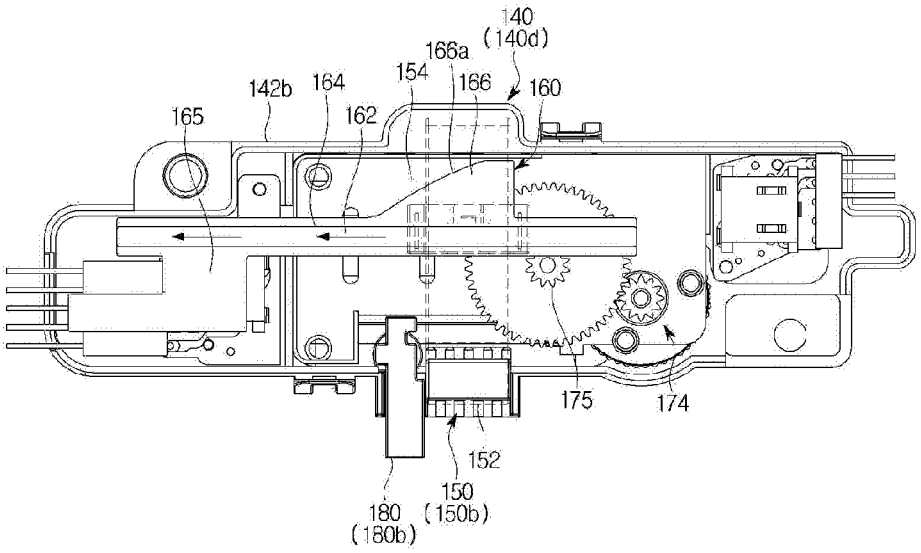

【Fig. 13】
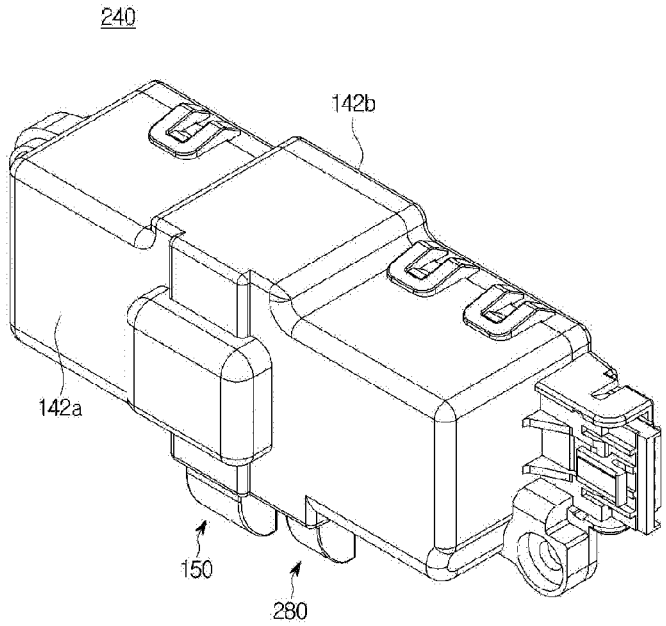

【Fig. 14】
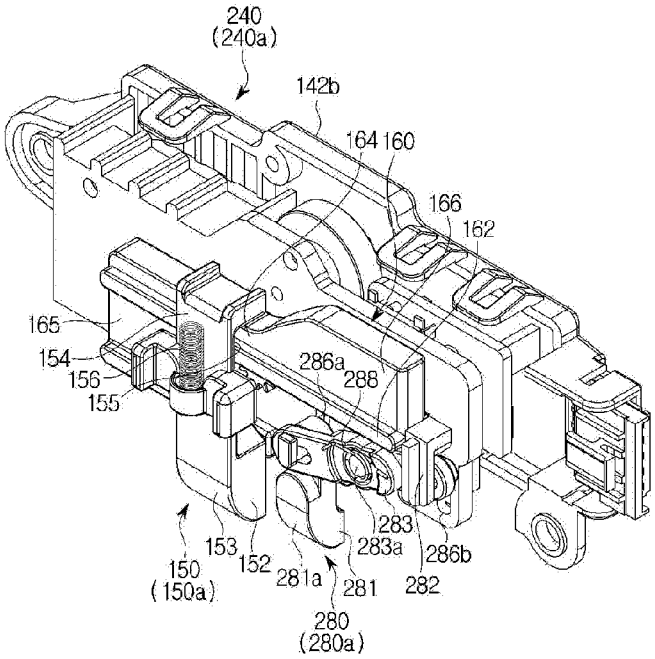

【Fig. 15】
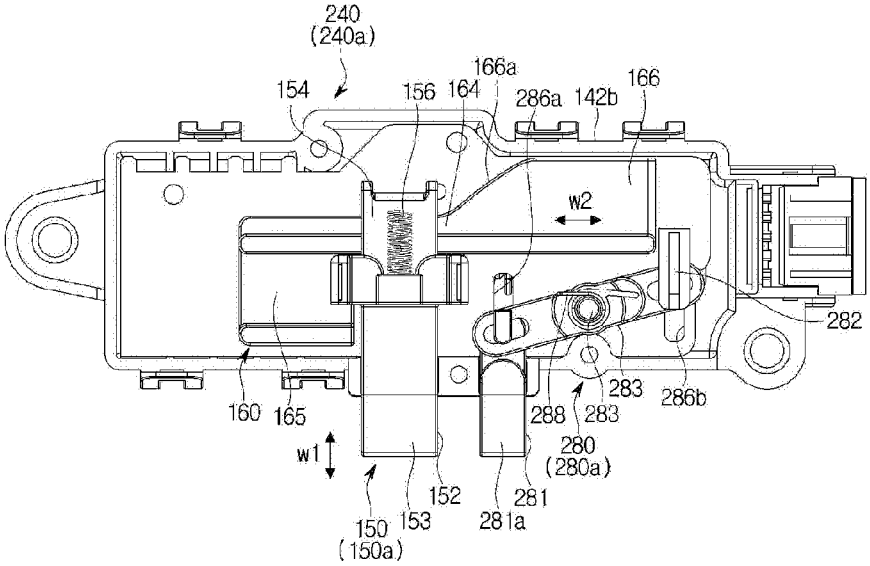

【Fig. 16】
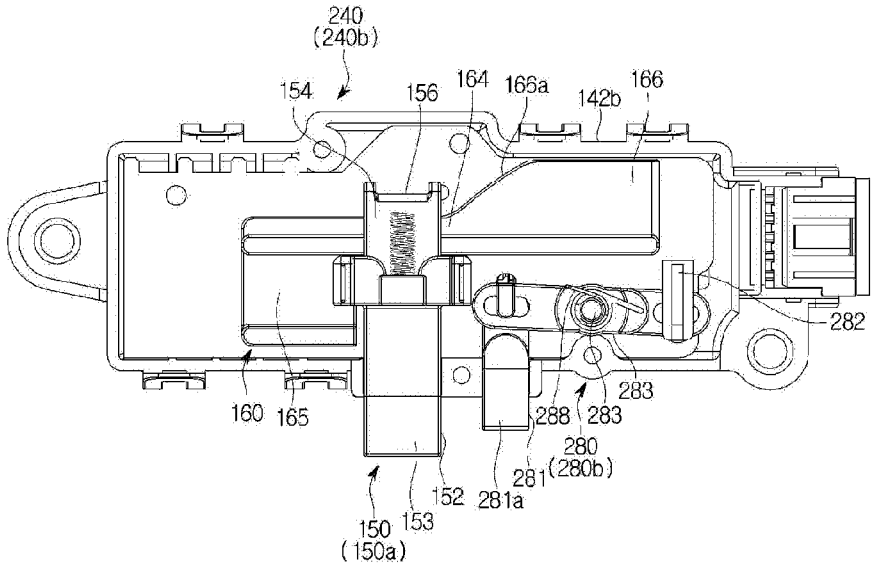

【Fig. 17】
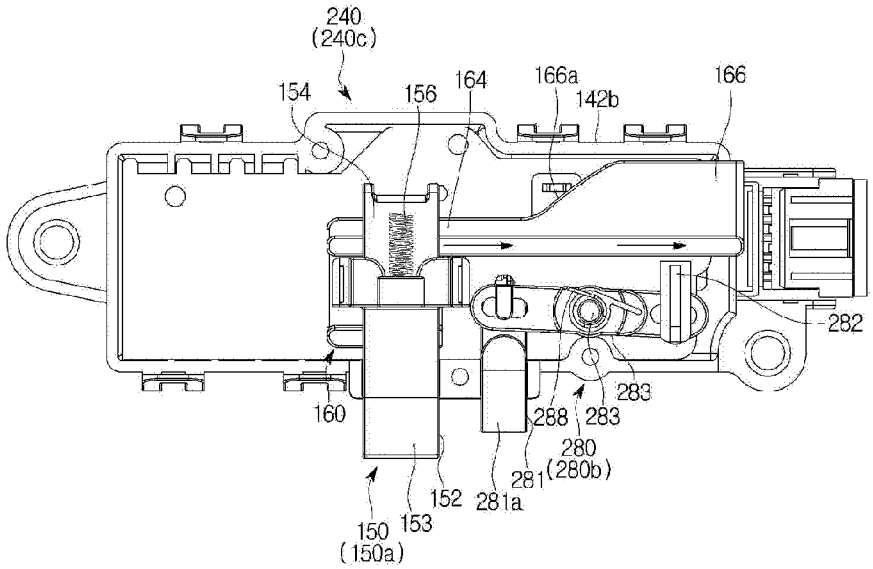

【Fig. 18】
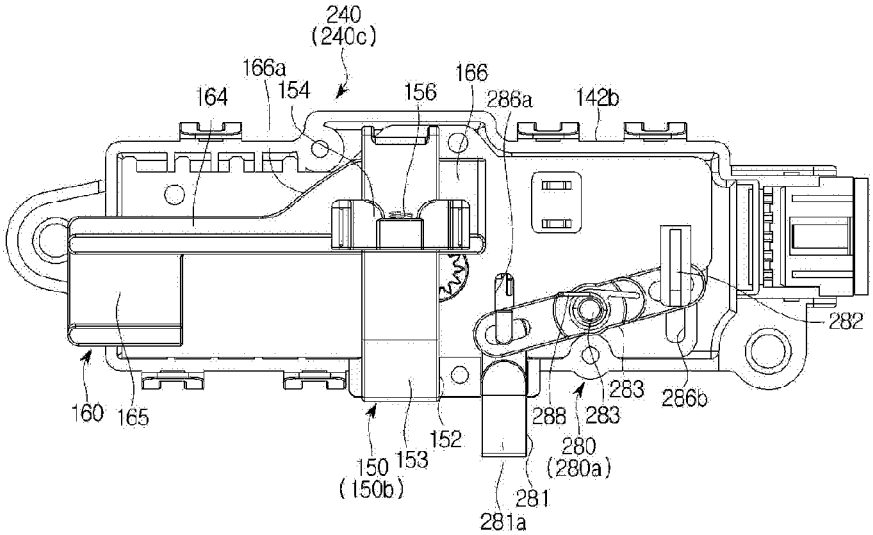

【Fig. 19】
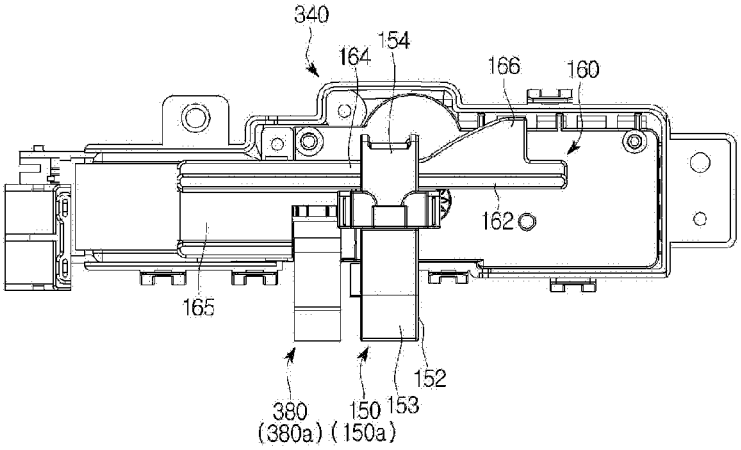

【Fig. 20】
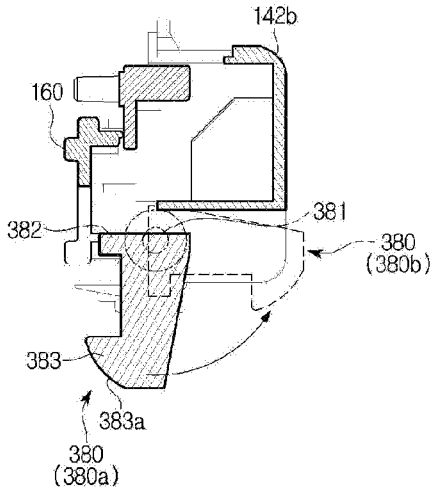

【Fig. 21】
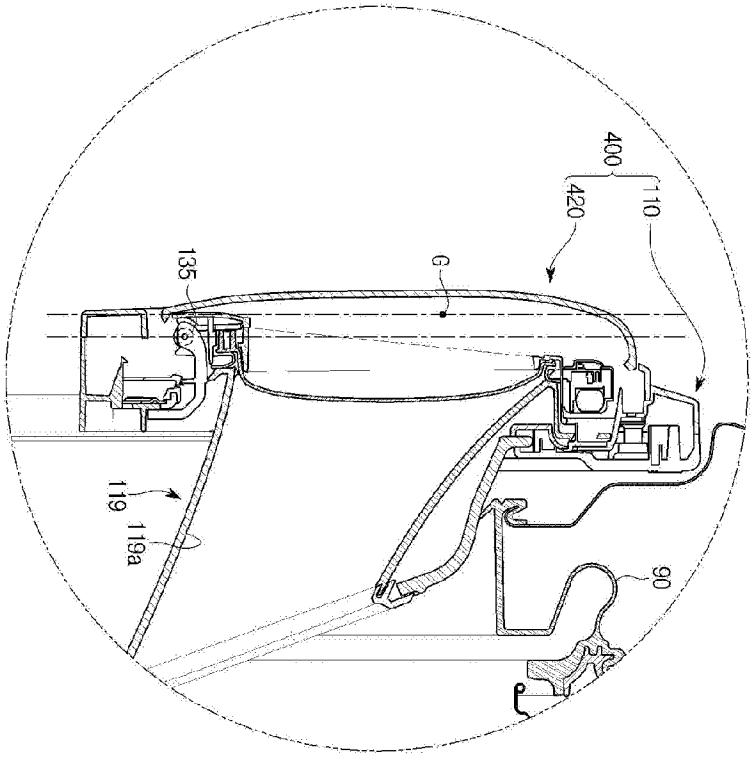

【Fig. 22】
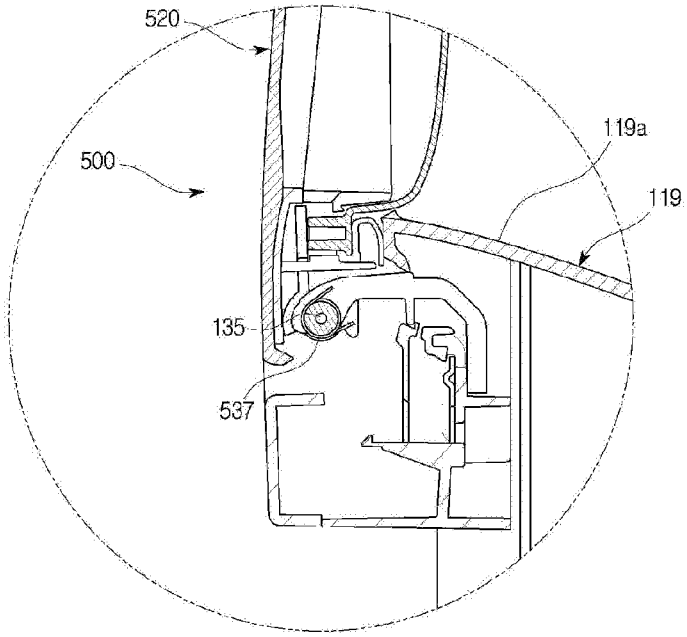

【Fig. 23】
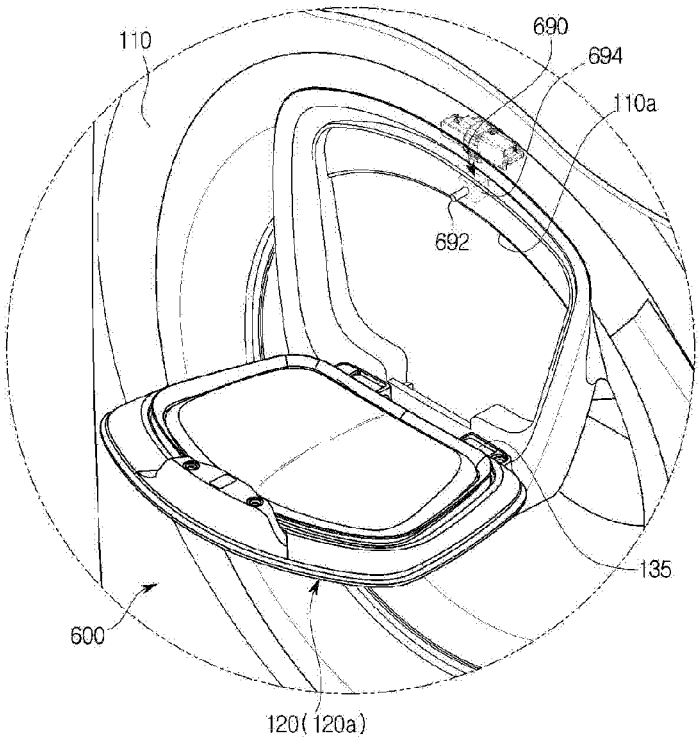

DOOR LOCKING DEVICE AND WASHING MACHINE HAVING THE SAME

CROSS-REFERENCE TO RELATED APPLICATIONS AND CLAIM OF PRIORITY

The present application claims priority under 35 U.S.C. § 365 and is a 371 National Stage of International Application No. PCT/KR2017/001383 filed Feb. 8, 2017, which claims the benefit of Korean Patent Application No. 10-2016-0019130 filed Feb. 18, 2016, the disclosures of which are fully incorporated herein by reference into the present disclosure as if fully set forth herein.

TECHNICAL FIELD

The present disclosure relates to a washing machine into which additional laundry can be inserted even without opening a door through an auxiliary laundry inlet formed at the door, and more particularly, to a locking device for an auxiliary door configured to open and close the auxiliary laundry inlet.

BACKGROUND

Generally, a washing machine is an apparatus that uses electricity to wash clothes, and types of washing machine include a drum washing machine in which a rotary tub is horizontally disposed and laundry is lifted upward and dropped along an inner peripheral surface of the rotary tub when the rotary tub rotates in forward and reverse directions with respect to a horizontal axis so that laundry is washed and a vertical-axis washing machine in which a rotary tub with a pulsator therein is vertically disposed and laundry is washed using a water current generated by the pulsator when the rotary tub rotates in forward and reverse directions with respect to a vertical axis.

Generally, a drum washing machine includes a cabinet, a tub configured to store wash water inside the cabinet, and a drum configured to contain laundry and rotatably installed inside the tub. The cabinet includes an opening for inserting laundry into the drum, and the opening is opened and closed by a door.

During a washing process, because a tub of a drum washing machine is filled to a certain level with wash water, a door has to be opened after the wash water stored in the tub is drained for additional laundry to be inserted during the washing process. For such a problem, the present disclosure proposes a washing machine in which an auxiliary laundry inlet is formed at a door of the washing machine so that additional laundry can be inserted via the auxiliary laundry inlet without opening the door while the washing machine is filled with wash water during the washing process.

SUMMARY

It is an aspect of the present disclosure to provide a washing machine having a locking device for an auxiliary door configured to open and close an auxiliary laundry inlet for inserting additional laundry during a washing process.

It is another aspect of the present disclosure to provide a washing machine in which an auxiliary door mounted at a door of the washing machine is automatically opened.

A door locking device according to the idea of the present disclosure includes a latch configured to move in a first direction to restrict a door and move in a second direction, which is opposite the first direction, to release the restriction on the door, and a locker configured to move in a third direction, which is different from the first direction and the second direction, to limit movement of the latch in the second direction and move in a fourth direction, which is opposite the third direction, to move the latch in the second direction.

The locker may include a lifter protruding in the second direction.

The latch may include a latch groove formed to be recessed at a portion at which the latch crosses the locker.

The door locking device may further include a driving source configured to provide power for moving the locker in the third direction and the fourth direction, and a pinion gear configured to receive power from the driving source and rotate, and the locker may include a rack gear disposed on a body of the locker and configured to be engaged with the pinion gear to receive power.

The door locking device may include a locking stopper configured to limit movement of the locker in the third direction.

The locking stopper may not limit movement of the locker when the door is closed.

The third direction may be perpendicular to the first and second directions.

A washing machine according to the idea of the present disclosure includes a cabinet having a laundry inlet formed therein, a door configured to open and close the laundry inlet, an opening formed in the door, an auxiliary door configured to open and close the opening, and a door locking device configured to keep the auxiliary door closed, wherein the door locking device includes a latch engaged with the auxiliary door to keep the auxiliary door closed and move in a second direction from a position at which the latch is engaged with the auxiliary door to be detached from the auxiliary door, and a locker configured to move in a third direction, which is different from the second direction, to limit movement of the latch in the second direction.

A door can be locked or automatically opened with a locking device having a simple configuration.

BRIEF DESCRIPTION OF THE DRAWINGS

FIG. 1 is a perspective view of a washing machine according to an embodiment of the present disclosure.

FIG. 2 is a cross-sectional view of the washing machine according to the embodiment of the present disclosure.

FIG. 3A is an enlarged view of a state in which an auxiliary door of the washing machine according to the embodiment of the present disclosure is open.

FIG. 3B is an exploded perspective view of a state in which the auxiliary door of the washing machine according to the embodiment of the present disclosure is detached from a cabinet.

FIG. 4 is a view illustrating a state in which a door and the cabinet of the washing machine according to the embodiment of the present disclosure are detached.

FIG. 5 is a perspective view of a door locking device according to the embodiment of the present disclosure.

FIG. 6 is an exploded perspective view of the door locking device according to the embodiment of the present disclosure.

FIG. 7 is a view illustrating a partial configuration of the door locking device according to the embodiment of the present disclosure.

FIGS. 8 and 9 are views illustrating operations of the auxiliary door and the door locking device according to the embodiment of the present disclosure.

FIGS. 10, 11, and 12 are views illustrating an operation of the door locking device according to the embodiment of the present disclosure.

FIG. 13 is a perspective view of a door locking device according to another embodiment of the present disclosure.

FIG. 14 is a view illustrating a partial configuration of the door locking device according to the other embodiment of the present disclosure.

FIGS. 15, 16, 17, and 18 are views illustrating an operation of the door locking device according to the other embodiment of the present disclosure.

FIG. 19 is a front view of a partial configuration of a door locking device according to still another embodiment of the present disclosure.

FIG. 20 is a view illustrating an operation of a locking stopper according to the other embodiment of the present disclosure.

FIG. 21 is a cross-sectional view of an auxiliary door according to yet another embodiment of the present disclosure.

FIG. 22 is a cross-sectional view of an auxiliary door according to yet another embodiment of the present disclosure.

FIG. 23 is a view illustrating a door according to yet another embodiment of the present disclosure.

DETAILED DESCRIPTION

Embodiments described herein and configurations illustrated in the drawings are merely exemplary embodiments of the present disclosure, and various modifications which may replace the embodiments and the drawings herein may be present at the time of filing this application.

Like reference numerals or symbols presented in the drawings of the application indicate parts or elements that perform substantially the same functions.

Terms used herein are for describing the embodiments and are not intended to limit and/or restrict the disclosure. A singular expression includes a plural expression unless context clearly indicates otherwise. In the application, terms such as "include" or "have" should be understood as designating that features, number, steps, operations, elements, parts, or combinations thereof exist and not as precluding the existence of or the possibility of adding one or more other features, numbers, steps, operations, elements, parts, or combinations thereof in advance.

Terms including ordinals such as "first" and "second" may be used herein may be used to describe various elements, but the elements are not limited by the terms. The terms are only used for the purpose of distinguishing one element from another element. For example, a first element may be referred to as a second element while not departing from the scope of the present disclosure, and likewise, a second element may also be referred to as a first element. The term "and/or" includes a combination of a plurality of related described items or any one item among the plurality of related described items.

Hereinafter, embodiments according to the present disclosure will be described in detail below with reference to the accompanying drawings.

FIG. 1 is a perspective view of a washing machine according to an embodiment of the present disclosure, FIG. 2 is a cross-sectional view of the washing machine according to the embodiment of the present disclosure, FIG. 3A is an enlarged view of a state in which an auxiliary door of the washing machine according to the embodiment of the present disclosure is open, FIG. 3B is an exploded perspective view of a state in which the auxiliary door of the washing machine according to the embodiment of the present disclosure is detached from a cabinet, and FIG. 4 is a view illustrating a state in which a door and the cabinet of the washing machine according to the embodiment of the present disclosure are detached.

A washing machine 1 includes a cabinet 10 forming a washing space 5 therein, a tub 20 configured to store wash water or rinse water which will be used in a washing process or a rinsing process, and a driving motor 7 configured to rotate a drum 30. The washing space 5 inside the cabinet may be formed by the tub and the drum.

The cabinet 10 includes a top frame 10*a*, a front frame 10*b*, a rear frame 10*c*, and side frames 10*d* respectively forming a top surface, a front surface, a rear surface, and side surfaces of the cabinet.

A control panel 80 including input units 81*a* and 81*b* configured to receive an operation command of the washing machine 1 from a user and a display unit 83 configured to display operation information of the washing machine 1 is disposed at an upper portion of the front panel 10*b*.

A laundry inlet 11 (see FIG. 4) for inserting laundry into the drum 30 is disposed below the control panel 80 and at a center of the front panel 10*b*, and a door 100 configured to open and close the laundry inlet 11 is hinge-coupled to the front panel 10*b*.

A diaphragm 90 may be disposed between the laundry inlet 11 and an opening 21 of the tub 20. The diaphragm 90 may form a path from the laundry inlet 11 to the opening 21 of the tub 20 and reduce vibration transferred toward the front frame 10*b* during rotation of the drum 30. A portion of the diaphragm 90 may be disposed between a door unit 110 and the front frame 10*b* to prevent leakage of wash water in the tub 20 to outside of the cabinet 10.

A spring 17 configured to support the tub 20 from the top may be disposed between the tub 20 and the cabinet 10. The spring 17 serves to mitigate vibration and noise generated due to movement of the tub 20 with an elastic force.

A water supply pipe 13 configured to supply wash water to the tub 20 is installed above the tub 20. A water supply valve 14 is installed at one side of the water supply pipe 13.

A detergent supply device 40 is connected to the tub 20 via a connection pipe 16. Water supplied via the water supply pipe 13 is supplied to an inside of the tub 20 with a detergent via the detergent supply device 40.

The tub 20 is supported by a damper 42. The damper 42 connects an inner bottom surface of the cabinet 10 to an outer surface of the tub 20. The damper 42 may also be disposed at top, left, and right sides of the cabinet 10 in addition to the inner bottom surface of the cabinet 10 and support the tub 20. The damper 42 or the spring 17 may be disposed above or below the tub 20 and mitigate vibration and impact generated due to vertical movement of the tub 20.

A driving shaft 12 configured to transfer power of the driving motor 7 is connected to a rear surface of the drum 30. A plurality of through-holes 27 for circulation of wash water are formed along a circumference of the drum 30. A plurality of lifters 26 are installed at an inner peripheral surface of the drum 30 for laundry to be lifted and dropped during rotation of the drum 30.

The driving shaft 12 is disposed between the drum 30 and the driving motor 7. One end of the driving shaft 12 is connected to a rear plate of the drum 30, and the other end of the driving shaft 12 extends to an outside of a rear wall of the tub 20. When the driving motor 7 drives the driving shaft 12, the drum 30 connected to the driving shaft 12 rotates about the driving shaft 12.

A bearing housing 8 configured to rotatably support the driving shaft 12 is installed at the rear wall of the tub 20. The bearing housing 8 may be formed of an aluminum alloy and may be inserted into the rear wall of the tub 20 during injection molding of the tub 20. Bearings 9 may be installed between the bearing housing 8 and the driving shaft 12 to facilitate rotation of the driving shaft 12.

A drainage pump 4 configured to discharge water inside the tub 20 to outside of the cabinet 10, a connecting hose 3 configured to connect the tub 20 to the drainage pump 4 for water inside the tub 20 to be introduced into the drainage pump 4, and a drainage hose (not illustrated) configured to guide water pumped by the drainage pump 4 to outside of the cabinet 10 are disposed below the tub 20.

The door 100 may include a door unit 110 that corresponds to the laundry inlet 11 and an auxiliary door 120 configured to open and close an auxiliary laundry inlet 111 disposed in the door unit 110.

The door unit 110 may be disposed to be rotatable with respect to the cabinet 10. The door unit 110 may include a door frame 112 and a door glass 121.

The door frame 112 has a structure in which a front door frame 112*a* and a rear door frame 112*b* are coupled. Although the door frame 112 is formed in a substantially annular shape in the embodiment of the present disclosure, the door frame 112 may also be formed in a quadrangular shape. The door glass 121 is disposed to be supported between the front door frame 112*a* and the rear door frame 112*b*.

For the inside of the drum to be visible from outside the washing machine even when the door 100 is closing the laundry inlet 11, the door glass 121 may be formed of a transparent material. The door glass 121 may be disposed to convexly protrude from the door frame 112 toward the inside of the cabinet 10. By such a configuration, the door glass 121 may be inserted into the laundry inlet 11 when the door 100 is closed.

A hinge 114 is disposed at a periphery of the laundry inlet 11 for the door 100 to be rotatable with respect to the cabinet 10 and is coupled to a hinge coupler 115 formed at one side of the door unit 110. A hook 116 may be provided at the other side of the door frame 112, and a hook accommodator 118 may be disposed in the front panel 10*b* corresponding to the hook 116 to maintain a state in which the door 100 closes the laundry inlet 11.

The auxiliary laundry inlet 111 is disposed in the door 100 for laundry to be inserted into the washing machine even when the door 100 is closed. Although the auxiliary laundry inlet 111 is disposed in the door unit 110 in the embodiment of the present disclosure, a hole may be drilled in the door glass 121 to form the auxiliary laundry inlet therein.

Laundry has to pass through the door glass 121 to be inserted into the washing machine via the auxiliary laundry inlet 111 of the door unit 110. For this, a glass through-hole 121*a* is disposed in the door glass 121. As an alternative, an upper portion of the door glass may be recessed to prevent the door glass from being disposed behind the auxiliary laundry inlet 111.

To connect the auxiliary laundry inlet 11 of the door unit 110 to the glass through-hole 121*a* of the door glass 121, the door unit 110 may include a connection guide 119. The connection guide 119 may have both open ends and be formed in a tubular shape having a hollow.

Specifically, the connection guide 119 may have one end connected to the auxiliary laundry inlet 111 and the other end connected to the glass through-hole 121*a*. In the present embodiment, the connection guide 119 may be disposed to be inclined downward from the front toward the rear. That is, the one end of the connection guide 119 connected to the auxiliary laundry inlet 111 is disposed at a higher position than the other end thereof. By such a configuration, laundry may be easily inserted into the drum 30 via the auxiliary laundry inlet 111.

The auxiliary door 120 is rotatably mounted at the door unit 110 to open and close the auxiliary laundry inlet 111. The auxiliary door 120 may be formed of an insulating or heat-resistant material. This is to prevent heat inside the cabinet 10 from being transferred to outside of the auxiliary door 120 in a case of a washing machine having a drying function in which temperature inside the cabinet 10 may rise.

An elastic gasket 130 is disposed at a portion of a rear surface of the auxiliary door 120 at which the auxiliary door 120 comes in contact with a periphery of a circumference of the auxiliary laundry inlet 111. The elastic gasket 130 has a shape corresponding to that of the auxiliary laundry inlet 111 and seals a gap between the auxiliary laundry inlet 111 and the auxiliary door 120 when the auxiliary door 120 is closing the auxiliary laundry inlet 111. The elastic gasket 130 may be formed of an elastic material such as rubber or have a structure such as a tubular structure having elasticity. Consequently, the auxiliary door 120 is biased in a direction in which the auxiliary door 120 is opened when the auxiliary door 120 is closed. That is, when a force that keeps the auxiliary door 120 closed disappears, the auxiliary door 120 may be automatically opened due to an elastic restoration force of the elastic gasket 130.

An auxiliary door hinge 135 is disposed at the auxiliary door 120 and is installed at an auxiliary door coupler 117 disposed in the door unit 110. Although the auxiliary door 120 is biased in the direction in which the auxiliary door 120 is opened due to the restoration force of the elastic gasket 130 in the embodiment of the present disclosure, an elastic member 537 (see FIG. 22) may be installed at the auxiliary door hinge 135 and reinforce an automatic opening function of the auxiliary door 120. This will be described below.

To keep the auxiliary door 120 closed, the door 100 may include a door locking device 140 (see FIG. 3). The door locking device 140 will be described in detail below.

FIG. 5 is a perspective view of a door locking device according to an embodiment of the present disclosure, and FIG. 6 is an exploded perspective view of the door locking device according to the embodiment of the present disclosure.

The door locking device 140 is disposed above the auxiliary laundry inlet 111 and is mounted between the front door frame 112*a* and the rear door frame 112*b* such that only a portion of the door locking device 140 is exposed to the outside. The door locking device 140 serve to keep the auxiliary door 120 closed or lock the auxiliary door 120. Here, keeping the auxiliary door 120 closed means that the auxiliary door 120 is kept unopened unless an external force is applied thereto, that is, the auxiliary door 120 is manipulated by a user, and locking the auxiliary door 120 means that the auxiliary door 120 is locked in a closed state so that the auxiliary door 120 is not opened even when a user attempts to open the auxiliary door 120. In the present disclosure, an unlocked state will be used as a term relative to a locked state of the auxiliary door 120. Because the auxiliary door 120 is kept closed when not manipulated by a user even in the unlocked state of the auxiliary door 120, the closed state of the auxiliary door 120 is the same as the unlocked state. To sum up, the auxiliary door 120 may be in any one state of the open state, the closed state, and the locked state.

The door locking device 140 may include a housing 142, a latch 150, and a locker 160.

The housing 142 forms an exterior of the door locking device 140 and is configured to protect components mounted therein. Components such as the latch 150 and the locker 160 which will be described below may be mounted inside the housing 142. At least a portion of the latch 150 may protrude from the housing 142 and be engaged with the auxiliary door 120. A locking stopper 180 which will be described below may also protrude from the housing 142.

The housing 142 may be divided into a front housing 142*a* and a rear housing 142*b*. Components may be mounted in a space formed between the front housing 142*a* and the rear housing 142*b* due to coupling therebetween.

The latch 150 has a substantially bar shape and is mounted inside the housing 142 so that a latch head 152 disposed at one end of the latch 150 protrudes to outside of the housing 142. The protruding latch head 152 is exposed above the auxiliary laundry inlet 111 when the auxiliary door 120 is open, and the latch head 152 is fitted into an insertion groove 122 disposed at an upper portion of the auxiliary door 120 and keeps the auxiliary door 120 closed when the auxiliary door 120 is closed. For this, the latch 150 may be disposed to vertically reciprocate, and a guide protrusion 143 protruding forward is disposed at the front housing 142*a* to guide a reciprocating path of the latch 150. A latch leg 151 protruding forward from a middle portion of the latch 150 is accommodated in an inner space of the f142 formed by the guide protrusion 143. In the embodiment of the present disclosure, a pair of latch legs 151 protruding forward from both sides of the latch 150 are configured to slide along both walls of an inner space of the guide protrusion 143. A spring support 151*a* is formed between the pair of latch legs 151, and a latch spring 156 is disposed between the spring support 151*a* and an upper wall of the inner space of the guide protrusion 143 such that the latch 150 is biased downward.

A latch slope 153 that is curved is disposed at a portion of the latch head 152 coming in contact with the auxiliary door 120 so that the latch 150 may retreat upward due to a force of the auxiliary door 120 pressing the latch 150 rearward when the auxiliary door 120 is closed. To restrict reciprocating motion of the latch 150, a latch groove 155 that is recessed is disposed at a rear portion of the latch 150. The latch groove 155 may be defined as a space formed between an upper wall 154 protruding rearward from the other end of the latch head 152 and a bottom 157 formed at a position opposite the upper wall 154. The latch groove 155 may form a path along which the locker 160 moves, and the reciprocating motion of the latch 150 may be restricted or the latch 150 may be pressed to retreat depending on a portion of the locker 160 placed in the latch groove 155.

The locker 160 includes a locker body 162 having a substantially bar shape. When a longitudinal direction or a reciprocating direction of the latch 150 is defined as a first direction W1, a longitudinal direction or a reciprocating direction of the locker 160 may be referred to as a second direction W2, which is different from the first direction W1. Although the first direction W1 is a vertical direction and the second direction W2 is a horizontal direction in the present embodiment, the first direction and the second direction are not necessarily perpendicular to each other, and the first direction and the second direction are not necessarily linear. For example, when a cylindrical locker rotates in a circumferential direction, the second direction w2 may be the circumferential direction. In the present embodiment, the first direction w1 and the second direction w2 may be orthogonal to each other. The latch 150 may move in a first-a direction w1*a* to restrict the auxiliary door 120 or move in a first-b direction w1*b*, which is opposite the first-a direction w1*a*, to release the restriction on the auxiliary door 120. The first-a direction w1*a* and the first-b direction w1*b* may be components of the first direction w1.

The locker body 162 may have a length in the second direction w2 and include a holder 165 formed at one end thereof, a lifter 166 formed at a certain distance from the holder 165, and a connector 164 configured to connect the holder 165 and the lifter 166.

The holder 165 is a portion protruding downward from the locker body 162. When the holder 165 is placed in the latch groove 155 of the latch 150 while the locker 160 reciprocates, because movement of the bottom 157 of the latch groove 155 is limited due to the holder 165, retreating movement of the latch 150 may be restricted.

Conversely, the lifter 166 is formed to protrude upward from the locker body 162 and includes a lifter slope 166*a* whose degree of protrusion increases. Consequently, when the lifter 166 enters the latch groove 155 as the locker 160 moves in the second direction W2, the upper wall 154 of the latch groove 155 and the lifter slope 166*a* may come in contact with each other and slide such that the latch 150 is lifted and is caused to retreat. Specifically, the second direction w2 may include a second-a direction w2*a* and a second-b direction w2*b*, and the locker 160 may advance in the second-b direction w2*b*, lift the latch 150, and cause the latch 150 to retreat. The lifter slope 166*a* may be formed to be inclined in the second direction w2 for the latch to slide in the first direction. As the locker 160 moves in the second-a direction w2*a* and the holder 165 is placed in the latch groove 155, the retreating motion of the latch 150 may be restricted.

The holder 165 and the lifter 166 may be disposed opposite each other with respect to the connector 164. That is, the holder 165 may be disposed at one side and the lifter 166 may be disposed at the other side with the connector 164 being disposed therebetween. When the connector 164 is placed in the latch groove 155, because an upper surface of the connector 164 almost abuts the upper wall 154 of the latch groove 155, and a space is formed between the bottom 157 of the latch groove 155 and the connector 164, the latch 150 may retreat in a direction in which the latch 150 is lifted due to an external force. That is, when the auxiliary door 120 is open or closed, the connector 164 of the locker 160 is placed in the latch groove 155.

The door locking device 140 may include a locker driver 170 (see FIG. 6).

The locker driver 170 is configured to generate power for the locker 160 to move in the second direction W2. The locker driver 170 includes a driving source 172 and a gear assembly 174 configured to receive power from the driving source 172 and reciprocate the locker 160.

In the embodiment of the present disclosure, the driving source 172 is configured with a motor.

The gear assembly 174 may include a pinion gear 175. A rack gear 163 (see FIG. 7) configured to be engaged with the pinion gear 175 may be disposed at a rear portion of the locker body 162 of the locker 160.

Power generated by the driving source 172 is transmitted to the rack gear 163 via the pinion gear 175 so that the locker body 162 may linearly move.

FIG. 7 is a view illustrating a partial configuration of the door locking device according to the embodiment of the present disclosure, and FIGS. 8 and 9 are views illustrating operations of the door locking device depending on opening and closing of the auxiliary door according to the embodiment of the present disclosure.

The door locking device 140 may include the locking stopper 180.

The locking stopper 180 limits movement of the locker 160 when the auxiliary door 120 is open and releases the limit on the movement of the locker 160 when the auxiliary door 120 is closed.

For this, the locking stopper 180 is disposed to reciprocate in a third direction W3, which is perpendicular to the first direction W1 and the second direction W2. However, a moving direction of the locking stopper 180 is not necessarily perpendicular to the first direction W1 and the second direction W2, and the moving direction is not necessarily linear. In the embodiment of the present disclosure, a position of the locking stopper 180 when the auxiliary door 120 is open is defined as a limiting position 180*a*, and a position of the locking stopper 180 when the auxiliary door 120 is closed or locked is defined as a releasing position 180*b*. The locking stopper 180 at the limiting position 180*a* is disposed on a movement path of the locker 160 and almost abuts the holder 165 of the locker 160. Consequently, when the auxiliary door 120 is open, even when power is applied to the driving source 172 due to a certain error, the locking stopper 180 physically blocks movement of the locker 160, and thus the holder 165 is unable to move to the latch groove 155.

In a process in which the auxiliary door 120 is closed, the locking stopper 180 may be pushed rearward due to the auxiliary door 120 and may move from the limiting position 180*a* to the releasing position 180*b*. A rail groove 186 may be disposed inside the front housing 142*a*, and a sliding protrusion 181 accommodated in the rail groove 186 may be disposed at one side of the locking stopper 180 to guide movement of the locking stopper 180. A stopper spring 188 may be disposed between the locking stopper 180 and the rear housing 142*b* for the locking stopper 180 to be returned to the limiting position 180*a* from the releasing position 180*b* when the auxiliary door 120 is opened. Consequently, along with the auxiliary door 120 according to the present disclosure being biased in a direction in which the auxiliary door 120 is opened due to the elastic gasket 130, a force that causes the auxiliary door 120 to be biased in the direction in which the auxiliary door 120 is opened is applied to the auxiliary door 120 due to the stopper spring 188 pressing the locking stopper 180 forward.

In the embodiment of the present disclosure, the locking stopper 180 is installed adjacent to a side surface of the latch 150. Consequently, when the auxiliary door 120 is closed, the upper portion of the auxiliary door 120 comes in contact with the latch slope 153 and lifts the latch 150 upward while pushing the locking stopper 180 rearward and causing the locking stopper 180 to be deviated from the limiting position 180*a*. Then, when the auxiliary door 120 is closed, the locking stopper 180 is at the releasing position 180*b* and does not affect movement of the locker 160.

The insertion groove 122 may be disposed at the upper portion of the auxiliary door 120 as illustrated in FIG. 3. The insertion groove 122 is a space in which the latch 150 that retreats due to the auxiliary door 120 when the auxiliary door 120 is being closed may advance again and be returned to its original position when the auxiliary door 120 is completely closed. That is, the insertion groove 122 is formed by a portion of the upper portion of the auxiliary door 120 being recessed downward, and a threshold 123 (see FIG. 9) configured to press the latch slope 153 is formed at a rear portion of the insertion groove 122. A corner at which the threshold 123 comes in contact with the latch slope 153 may be rounded for the latch 150 to smoothly pass over the threshold 123.

A lifting member 124 is disposed to be lifted inside the insertion groove 122. The lifting member 124 is at a top dead point when the auxiliary door 120 is open as illustrated in FIG. 8 and is pressed by the latch 150 and at a bottom dead point when the auxiliary door 120 is closed as illustrated in FIG. 9. Although the lifting member 124 plays a role of blocking an inlet of the insertion groove 122 to prevent introduction of foreign substances into the insertion groove 122, as will be described below, a more important role of the lifting member 124 is to be interlocked to a manipulation unit 126 disposed at the auxiliary door 120 to push the latch 150 upward and open the auxiliary door 120. Consequently, although a separate elastic member may be disposed so that the lifting member 124 is biased in a direction in which the lifting member 124 is lifted, the lifting member 124 may be configured such that a position thereof is changed according to an opening angle of the auxiliary door 120 without an elastic member. The lifting member 124 may include a cam surface 124*a* formed with an inclined surface to switch a direction of a force pressing the lifting member 124 from the manipulation unit 126.

The manipulation unit 126 has at least a portion exposed to the front surface of the auxiliary door 120 and is configured to be pushed from the outside. The manipulation unit 126 may include a push button 127 partially exposed to the front surface of the auxiliary door 120, a button spring 128 configured to elastically support the push button 127, and a pressing disk 129 extending rearward from the push button 127 and configured to press the lifting member 124.

When the user presses the push button 127, the pressing disk 129 comes in contact with the cam surface 124*a* of the lifting member 124 and presses the lifting member 124. As the pressing disk 129 and the cam surface 124*a* slide, the lifting member 124 is lifted, and the latch 150 that has been in contact with the lifting member 124 is caused to retreat. When the latch 150 retreats, and an edge of the latch slope 153 is at a higher position than the threshold 123, the auxiliary door 120 is opened due to the elastic gasket 130, an elastic member 136 of the auxiliary door hinge 135, or the stopper spring 188 of the locking stopper 180 pressing the auxiliary door 120 in the direction in which the auxiliary door 120 is opened.

Hereinafter, opening and closing operations of the auxiliary door of the washing machine according to the embodiment of the present disclosure will be described.

FIGS. 10, 11, and 12 are views illustrating an operation of the door locking device according to the embodiment of the present disclosure. FIGS. 10, 11, and 12 will be described with reference to the above description of FIGS. 8 and 9.

The door locking device 140 may operate at a preparation mode 140*a*, a first mode 140*b*, a second mode 140*c*, and a third mode 140*d*.

When the auxiliary door 120 is open, the auxiliary door 120 and the door locking device 140 are disposed as illustrated in FIG. 8. In this state, because the connector 164 of the locker 160 is placed in the latch groove 155, the latch 150 may retreat, and as illustrated in FIG. 10, movement of the locker 160 is limited because the locking stopper 180 is blocking the holder 165 of the locker 160. This may be referred to as the preparation mode 140*a* of the door locking device 140.

When the auxiliary door 120 is closed by the user, as illustrated in FIG. 9, the latch 150 retreats until the latch 150 passes over the threshold 123 of the auxiliary door 120 and advances again after passing over the threshold 123 to be inserted into the insertion groove 122 of the auxiliary door 120 and press the lifting member 124 disposed in the insertion groove 122 downward. Because the locking stopper 180 is pushed rearward as the auxiliary door 120 is closed, the locker 160 is movable. This may be referred to as the first mode 140*b* of the door locking device 140.

As an alternative, the washing machine according to the present disclosure may include an auxiliary door opening/closing sensor (not illustrated) configured to detect a position of the locking stopper 180. For example, a lead switch may be mounted in the rear housing 142*b* of the door locking device 140, and a terminal of the lead switch may be disposed to come in contact with the auxiliary door 120 by the locking stopper 180 when the auxiliary door 120 is closed so that whether the auxiliary door 120 is open or closed is sensed through an on/off signal of the lead switch.

When the washing machine 1 is operated and a washing, rinsing, or spinning process is performed while the auxiliary door 120 is closed, the auxiliary door 120 is locked according to the operation state of the washing machine 1. Particularly, because the drum 30 rotates at a high speed during the spinning process, the auxiliary door 120 should be prevented from being opened due to carelessness of the user. For this, according to a control command applied from a controller of the washing machine 1, power is supplied to the driving source 172 of the door locking device 140, and the locker 160 is operated. As the locker 160 moves, as illustrated in FIG. 11, the holder 165 of the locker 160 is placed in the latch groove 155. As described above, because movement of the latch 150 is limited in the above state, the auxiliary door 120 is not opened even when the user presses the push button 127. This may be referred to as the second mode 140*c* of the door locking device 140.

When the user wants to open the auxiliary door 120 while the washing machine 1 is operating, the user may press an auxiliary door open button (not illustrated) disposed at the control panel 80 of the washing machine 1 and release the locked state of the auxiliary door 120. When a command to open the auxiliary door is input by the user, the washing machine 1 determines whether it is okay to release the locked state of the auxiliary door 120 in the current state of the washing machine 1. For example, the washing machine 1 determines whether half or more of the tub 20 is filled with wash water, whether the drum 30 is rotating, whether temperature inside the drum 30 is high, or the like. Then, when it is okay to release the locked state of the auxiliary door 120 in the current state of the washing machine 1, an automatic opening operation of the auxiliary door is performed.

The automatic opening operation of the auxiliary door according to the embodiment of the present disclosure begins with power being supplied to the driving source 172 of the door locking device 140 according to a control command applied from the controller of the washing machine 1. However, at this time, the locker 160 is moved in a direction opposite to a moving direction of the locker 160 when a state of the auxiliary door 120 is switched from the closed state to the locked state. That is, as illustrated in FIG. 12, the locker 160 moves in a direction in which the lifter 166 enters the latch groove 155, and as the latch 150 passes over the lifter slope 166*a* and retreats, the latch 150 in the insertion groove 122 of the auxiliary door 120 falls out from the insertion groove 122. When the latch 150 completely falls out of the insertion groove 122, the auxiliary door 120 is automatically opened due to the elastic restoration force that has been pressing the auxiliary door 120 in the direction in which the auxiliary door 120 is opened. This may be referred to as the third mode 140*d* of the door locking device 140.

The washing machine 1 according to the present disclosure may also perform the automatic opening operation of the auxiliary door when the spinning process is completed or a drying process is completed.

The washing machine 1 may be programmed to release the locked state of the auxiliary door 120 when a washing process, a rinsing process, and a spinning process are completed according to a washing course selected by the user, e.g., a standard washing course. Here, although the locked state of the auxiliary door 120 may be switched to the closed state and allow the user to open the auxiliary door 120, the washing machine 1 may be programmed so that the auxiliary door 120 is automatically opened when the locked state of the auxiliary door 120 is released. Generally, when a washing course is completed, a washing machine notifies a user that washing is completed by using sound, a display, or the like. When the auxiliary door 120 is opened along with the above notification, there may be various advantages. First, because vapor remaining inside the washing machine even after the washing course is completed is discharged to the outside via the auxiliary laundry inlet, an odor or propagation of bacteria that may be caused when a user does not recognize that washing is completed and does not open the door for a long period may be prevented. Also, a user who forgets to collect laundry that is completely washed may discover that the auxiliary door is open and remember to collect the laundry.

Hereinafter, a washing machine according to another embodiment of the present disclosure will be described.

In the description of the present embodiment, descriptions of configurations overlapping those described above will be omitted.

FIG. 13 is a perspective view of the door locking device according to another embodiment of the present disclosure, and FIG. 14 is a view illustrating a partial configuration of the door locking device according to the other embodiment of the present disclosure.

A door locking device 240 may include a locking stopper 280 that is operated in a different way from that of the previous embodiment.

When the auxiliary door 120 is open, the locking stopper 280 is disposed as illustrated in FIG. 15. The locking stopper 280 may be disposed on a movement path of the locker 160 moving in the second direction W2 and limit movement of the locker 160.

The locking stopper 280 is configured to move between a limiting position 280*a* (see FIG. 15) and a releasing position 280*b* (see FIG. 16). The locking stopper 280 at the limiting position 280*a* is disposed on the movement path of the locker 160 in the second direction W2 when the auxiliary door 120 is open. The locking stopper 280 at the limiting position 280*a* may come in contact with the lifter 166 of the locker 160. The locking stopper 280 prevents the holder 165 from being inserted into the latch groove 155. When the auxiliary door 120 is closed, the locking stopper 280 is at the releasing position 280*b*. That is, the locking stopper 280 deviates from the movement path of the locker 160 and releases the limit on the movement of the locker 160.

The locking stopper 280 may include a movable bar 281, a stopper body 282 operated in conjunction with the movable bar 281, and a connecting rod 283 configured to connect the movable bar 281 to the stopper body 282.

The connecting rod 283 is configured to be rotatable about a longitudinal center thereof and has one end connected to the movable bar 281 and the other end connected to the stopper body 282.

The movable bar 281 may include a contact surface 281*a* that is curved formed at a portion at which the movable bar 281 comes in contact with the auxiliary door 120. As the auxiliary door 120 is closed, the auxiliary door 120 may move while in contact with the contact surface 281*a* and cause the movable bar 281 to be pushed and moved upward.

The stopper body 282 is disposed opposite the movable bar 281 with the connecting rod 283 disposed therebetween. The stopper body 282 is dropped when the movable bar 281 is lifted, and the stopper body 282 is lifted when the movable bar 281 is dropped.

When the locking stopper 280 is at the limiting position 280*a*, the stopper body 282 may come in contact with the locker 160 to prevent the holder 165 from being inserted into the latch groove 155.

The door locking device 240 may include stopper moving rails 286*a* and 286*b* configured to guide vertical movement of the movable bar 281 and the stopper body 282. Specifically, the stopper moving rails may include a first stopper moving rail 286*a* configured to guide movement of the movable bar 281 and a second stopper moving rail 286*b* configured to guide movement of the stopper body 282.

The locking stopper 280 may be pushed by the auxiliary door 120 and move between the limiting position 280*a* and the releasing position 280*b*. That is, when the auxiliary door 120 is open, the locking stopper 280 is disposed at the limiting position 280*a*, thereby preventing movement of the locker 160 and preventing the locker 160 from restricting the latch 150. Specifically, here, the movable bar 281 is at a bottom dead point, and the stopper body 282 is at a top dead point such that the stopper body 282 interferes with movement of the locker 160.

When a state of the auxiliary door 120 is switched from the open state to the closed state, the locking stopper 280 is pushed by one side of the auxiliary door 120 and moves from the limiting position 280*a* to the releasing position 280*b*. That is, the movable bar 281 is lifted due to the auxiliary door 120, and the stopper body 282 is dropped and releases the restriction on the locker 160. In this way, the locking stopper 280 may release the restriction on the locker 160 and may restrict or lift the latch 150 according to movement of the locker 160.

The door locking device 240 may further include a stopper elastic member 288. When the auxiliary door 120 is opened, the locking stopper 280 move from the releasing position 280*b* to the limiting position 280*a*. Specifically, the movable bar 281 is moved downward, and the stopper body 282 is moved upward. The stopper elastic member 288 is configured to elastically support the locking stopper 280 so that the locking stopper 280 may be elastically restored from the releasing position 280*b* to the limiting position 280*a*. Specifically, the stopper elastic member 288 is disposed on a rotating shaft 283*a* of the connecting rod 283 and generates an elastic force in a direction in which the movable bar 281 is elastically restored downward.

Hereinafter, an operation of the washing machine according to the embodiment of the present disclosure will be described.

FIGS. 15, 16, 17, and 18 are views illustrating an operation of the door locking device according to the other embodiment of the present disclosure.

FIG. 15 illustrates a structure of the door locking device 240 when the auxiliary door 120 is open. In this state, because the locking stopper 280 is disposed on the movement path of the locker 160, movement of the locker 160 is limited. Specifically, the movable bar 281 is disposed downward, and the stopper body 282 is disposed upward so that the stopper body 282 interferes with movement of the locker 160. This may be referred to as a preparation mode 240*a* of the door locking device 240.

Here, because the latch 150 is disposed not to be restricted by the locker 160, the latch 150 may move between a locking position 150*a* and an opening position 150*b* in the first direction W1 according to opening and closing of the auxiliary door 120.

The door locking device 240 is configured to operate also at a first mode 240*b*, a second mode 240*c*, and a third mode 240*d*.

The first mode 240*b* is an operation mode at which the latch 150 is configured to be movable from the locking position 150*a* to the opening position 150*b*. The second mode 240*c* is an operation mode at which the latch 150 is restricted to the locking position 150*a* by the locker 160. The third mode 240*d* is an operation mode at which the latch 150 is moved from the locking position 150*a* to the opening position 150*b* by the locker 160.

When the auxiliary door 120 is closed, the door locking device 240 is at any one of the first to third modes. That is, when the locking stopper 280 is moved from the limiting position 280*a* to the releasing position 280*b* by the auxiliary door 120, the door locking device 240 may be operated at the first to third modes.

FIG. 16 is a view related to the first mode 240*b*. When the door locking device 240 is at the first mode 240*b*, the connector 164 of the locker 160 is placed in the latch groove 155 of the latch 150. That is, movement of the latch 150 is not restricted by the locker 160, and the latch 150 may fall out of the insertion groove 122. At the first mode 240*b*, the latch 150 may be moved to the opening position 150*b* by an external force or an electrical signal, and the auxiliary door 120 may be moved to the open state.

FIG. 17 is a view related to the second mode 240*c*. When the door locking device 240 is at the second mode 240*c*, the locker 160 may restrict movement of the latch 150. Specifically, the holder 165 of the locker 160 may be inserted into the latch groove 155 of the latch 150 and prevent movement of the latch 150 from the locking position 150*a* to the opening position 150*b*. In this way, the door locking device 240 may restrict the auxiliary door 120 to the locked state. In a washing, spinning, or drying process, opening of the auxiliary door 120 may be forcibly limited for the user to safely operate the washing machine.

FIG. 18 is a view related to the third mode 240*d*. When the door locking device 240 is at the third mode 240*d*, the locker 160 may press the latch 150 and allow the auxiliary door 120 to be opened. Specifically, the lifter 166 of the locker 160 is inserted into the latch groove 155 of the latch 150, and the latch 150 is lifted from the locking position 150*a* to the opening position 150*b*. Specifically, the latch groove 155 moves along the lifter slope 166*a* of the lifter 166, and the latch 150 move from the locking position 150*a* to the opening position 150*b*. In this way, the door locking device 240 may release the restriction on the auxiliary door 120, and the auxiliary door 120 is automatically opened. In this case, interference with the locking stopper 280 by the auxiliary door 120 is released, and the locking stopper 280 is elastically restored to the limiting position 280*a* by the stopper elastic member 288. Specifically, the movable bar 281 moves downward, and the stopper body 282 move upward.

Hereinafter, a washing machine according to still another embodiment of the present disclosure will be described.

In the description of the present embodiment, descriptions of configurations overlapping those described above will be omitted.

FIG. 19 is a front view of a partial configuration of the door locking device according to still another embodiment of the present disclosure, and FIG. 20 is a view illustrating an operation of a locking stopper according to the other embodiment of the present disclosure.

A door locking device 340 may include a locking stopper 380 that is operated in a different way from those of the previous embodiments.

The locking stopper 380 is configured to prevent movement of the locker 160 when the auxiliary door 120 is open. That is, the locking stopper 380 may be disposed on a movement path of the locker 160 moving in the second direction W2 and selectively limit movement of the locker 160.

The locking stopper 380 is configured to move between a limiting position 380*a* and a releasing position 380*b*. The locking stopper 380 at the limiting position 380*a* is disposed on the movement path of the locker 160 in the second direction W2 when the auxiliary door 120 is open. The locking stopper 380 at the limiting position 380*a* may come in contact with the holder 165 of the locker 160. The locking stopper 280 prevents the holder 165 from being inserted into the latch groove 155. When the auxiliary door 120 is closed, the locking stopper 380 at the releasing position 380*b* deviates from the movement path and releases the limit on the locker 160.

The locking stopper 380 may include a stopper rotating shaft 381, a stopper body 382, and a pressed protrusion 383.

The pressed protrusion 383 may include a protrusion contact surface 383*a* that is curved and faces the auxiliary door 120. As the auxiliary door 120 moves from an opening position 120*a* to a closing position 120*b*, the auxiliary door 120 may move while in contact with the protrusion contact surface 383*a* of the pressed protrusion 383 and cause the pressed protrusion 383*a* to be pushed and the locking stopper 380 to be rotated from the limiting position 380*a* to the releasing position 380*b*. That is, the pressed protrusion 383 may interfere with the auxiliary door 120 and be rotated.

The stopper body 382 is disposed to be rotatable about the stopper rotating shaft 381. When the locking stopper 380 is at the limiting position 380*a*, the stopper body 382 may come in contact with the locker 160 and prevent the holder 165 from being inserted into the latch groove 155.

Then, when the auxiliary door 120 moves to the closing position 120*b*, the pressed protrusion 383 is pressed by the auxiliary door 120 and is rotated about the stopper rotating shaft 381 with the stopper body 382, and the locking stopper 380 is moved from the limiting position 380*a* to the releasing position 380*b*. That is, the locking stopper 380 deviates from the movement path of the locker 160 and releases the limit on the movement of the locker 160.

Hereinafter, a washing machine according to yet another embodiment of the present disclosure will be described.

In the description of the present embodiment, descriptions of configurations overlapping those described above will be omitted.

FIG. 21 is a cross-sectional view of an auxiliary door according to yet another embodiment of the present disclosure.

A door 400 may be configured to be switched to an open state from a closed state even without an external force when restriction on an auxiliary door 420 by the door locking device 140 is released.

The auxiliary door 420 may be configured so that a center of mass thereof is disposed in front of the auxiliary door hinge 135. Because the center of mass of the auxiliary door 420 is disposed in front of the auxiliary door hinge 135, when the door locking device 140 releases the restriction on the auxiliary door 420, the auxiliary door 420 is automatically opened due to gravity.

Hereinafter, a washing machine according to yet another embodiment of the present disclosure will be described.

In the description of the present embodiment, descriptions of configurations overlapping those described above will be omitted.

FIG. 22 is a cross-sectional view of an auxiliary door according to yet another embodiment of the present disclosure.

A door 500 may be configured to be automatically opened even without an external force when restriction on an auxiliary door 520 by the door locking device 140 is released.

The auxiliary door hinge 135 may include a hinge elastic member 537. The hinge elastic member 537 is configured to be elastically restored in a direction in which the auxiliary door 520 is opened. The hinge elastic member 537 may be configured to have the same central axis as a rotation axis of the auxiliary door hinge 135.

In this way, when the door locking device 140 releases the restriction on the auxiliary door 520, the automatic opening function of the auxiliary door 120 may be performed by the hinge elastic member 537. In addition to the restoration force of the above-described elastic gasket 130, the auxiliary door 120 may be configured to receive a larger force in a direction in which the auxiliary door 120 is opened due to an elastic restoration force of the hinge elastic member 537 installed at the auxiliary door hinge 135.

Hereinafter, a washing machine according to yet another embodiment of the present disclosure will be described.

In the description of the present embodiment, descriptions of configurations overlapping those described above will be omitted.

FIG. 23 is a view illustrating a door according to yet another embodiment of the present disclosure.

A door 600 has an additional configuration for pressing the auxiliary door 120 in a direction in which the auxiliary door 120 is opened when restriction on the auxiliary door 120 by the door locking device 140 is released.

The door 600 may include a pushing device 690.

The pushing device 690 may include a push rod 692 and a rod mover 694 configured to move the push rod 692. The push rod 692 may be configured to protrude to outside of the door unit 110 and press an inner surface of the auxiliary door 120. The rod mover 694 may receive an electrical signal from a controller (not illustrated) and be operated, and the rod mover 694 may selectively protrude the push rod 692 to press the inner surface of the auxiliary door 120.

In this way, when the door locking device 140 releases the restriction on the auxiliary door 120, the rod mover 694 moves the push rod 692, the push rod 692 presses the inner surface of the auxiliary door 120, and the auxiliary door 120 is automatically opened.

Specific embodiments have been illustrated and described above. However, the present disclosure is not limited to the above embodiments, and one of ordinary skill in the art to which the disclosure pertains should be able to modify and practice the present disclosure in other various ways without departing from the gist of the present disclosure described in the claims below.

The invention claimed is:

1. A door locking device positioned in a stationary member and configured to restrict a door, the door locking device comprising:

a latch comprising a latch groove, the latch being configured to move in a first direction to be received in an insertion groove on the door and to restrict movement of the door and move in a second direction, which is opposite the first direction, to release the restriction on the movement of the door;

a locker configured to move in a third direction, which is different from the first direction and the second direction, the locker comprising a holder to be inserted into the latch groove to limit movement of the latch in the second direction, the locker further comprising a lifter protruding in the second direction so that when the locker moves in a fourth direction, which is opposite the third direction, the lifter is configured to contact the latch to move the latch in the second direction; and a locker actuator configured to move the locker in the third direction and the fourth direction.

2. The door locking device of claim 1, wherein the locker actuator comprises:

a driving source configured to provide power for moving the locker in the third direction and the fourth direction; and a pinion gear configured to receive the power from the driving source and rotate, wherein the locker includes a rack gear disposed on a body of the locker and configured to be engaged with the pinion gear to receive the power.

3. The door locking device of claim 1, comprising a locking stopper configured to limit movement of the locker in the third direction when the door is open.

4. The door locking device of claim 3, wherein the locking stopper does not limit movement of the locker when the door is closed.

5. The door locking device of claim 1, wherein the first direction and the third direction are perpendicular to each other.

* * * * *